US007023397B2

(12) United States Patent
Kurashima et al.

(10) Patent No.: US 7,023,397 B2
(45) Date of Patent: Apr. 4, 2006

(54) ANTENNA DEVICE HAVING A GROUND PLATE AND A FEEDING UNIT EXTENDING FROM THE GROUND PLATE FOR A PREDETERMINED LENGTH AND AT A PREDETERMINED ANGLE

(75) Inventors: Shigemi Kurashima, Shinagawa (JP); Masahiro Yanagi, Shinagawa (JP); Hiroto Inoue, Shinagawa (JP); Takuya Uchiyama, Shinagawa (JP); Junichi Akama, Shinagawa (JP); Noboru Fujii, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/960,038

(22) Filed: Oct. 8, 2004

(65) Prior Publication Data

US 2005/0168394 A1 Aug. 4, 2005

(30) Foreign Application Priority Data

Jan. 30, 2004 (JP) ..... 2004-023875

(51) Int. Cl.
*H01Q 13/00* (2006.01)

(52) U.S. Cl. ..... 343/845; 343/773; 343/846

(58) Field of Classification Search ..... 343/773, 343/829, 845, 846
See application file for complete search history.

(56) References Cited

U.S. PATENT DOCUMENTS

| | | | | |
|---|---|---|---|---|
| 4,947,181 | A * | 8/1990 | Duncan et al. | 343/773 |
| 6,198,454 | B1 * | 3/2001 | Sharp et al. | 343/773 |
| 2001/0017603 | A1 * | 8/2001 | Teshirogi et al. | 343/845 |
| 2004/0233118 | A1 * | 11/2004 | Jocher | 343/773 |
| 2005/0122274 | A1 * | 6/2005 | Marsan et al. | 343/773 |

OTHER PUBLICATIONS

T. Taniguchi et al., "An Omnidirectional and Low-VSWR Antenna for the FCC-Approved UWB Frequency Band", published by The Institute of Electronics, Information and Communication Engineers, B-1-133, p. 133.

* cited by examiner

*Primary Examiner*—Tho Phan
(74) *Attorney, Agent, or Firm*—Staas & Halsey LLP

(57) ABSTRACT

A disclosed antenna device includes a plate-like ground plate, and a feeding unit that extends from the ground plate for a predetermined length at a predetermined angle. The feeding unit is constituted by a half-body, which is a body, such as a circular cone, halved by a plane perpendicular to the ground plate, and the feeding unit is prepared perpendicular to the ground plate.

15 Claims, 26 Drawing Sheets

ANTENNA DEVICE HAVING A GROUND PLATE AND A FEEDING UNIT EXTENDING FROM THE GROUND PLATE FOR A PREDETERMINED LENGTH AND AT A PREDETERMINED ANGLE

BACKGROUND OF THE INVENTION

1. Field of the Invention

The present invention generally relates to an antenna device, and especially relates to an antenna device that includes a ground plate that is shaped like a plate, and a feeding unit that extends at a predetermined angle from the ground plate for a predetermined length, the feeding unit being prepared perpendicular to the ground plate.

2. Description of the Related Art

[Background of the Invention]

In recent years and continuing, radio communications technology using UWB (ultra-wide band) attracts attention since radar positioning and communications with a large transmission capacity are possible. As for UWB, the U.S. FCC (Federal Communications Commission) allowed use of a 3.1–10.6 GHz band in 2002.

Communications at UWB are performed by sending a pulse signal using a wide frequency band. Accordingly, an antenna device used for UWB has to be capable of receiving a wide band signal.

For UWB communications, at least in the 3.1–10.6 GHz frequency band approved by the FCC, an antenna device consisting of a ground plate and a feeder is proposed (Non-patent Reference 1).

FIGS. 1A and 1B show structures of conventional antenna devices.

An antenna device 10 shown in FIG. 1A is constituted by a feeding unit 12 in the shape of a circular cone arranged on a ground plate 11 with the top (apex) of the circular cone facing the ground plate 11.

Here, the circular cone is set up such that the side of the circular cone and an axis 13 that is perpendicular to the ground plate 11 make an angle θ. A desired antenna device property is obtained by setting the angle θ.

An antenna device 20 shown in FIG. 1B is constituted by a feeding unit 22 in the shape of a teardrop that consists of a circular cone 22*a*, and a sphere 22*b* inscribed in the circular cone 22*a*. Here, the feeding unit 22 is arranged on the ground plate 11 with the top of the circular cone 22*a* facing the ground plate 11.

[Non-patenting Reference 1]

"An Omnidirectional and Low-VSWR Antenna for the FCC-Approved UWB Frequency Band", published by The Institute of Electronics, Information and Communication Engineers, B-1–133, page 133, Takuya Taniguchi and Takehiko Kobayashi (The Tokyo Electric. University) (Presented on Mar. 22, 2003 at classroom B201).

[Description of the Invention]

[Problem(s) to be Solved by the Invention]

Nevertheless, the conventional wideband antenna devices structured by feeding units that are in the shape of a circular cone and teardrop formed on the plate-like ground plate tend to be large in size. Accordingly, an antenna device having smaller dimensions is desired.

SUMMARY OF THE INVENTION

It is a general object of the present invention to provide an antenna device that is small and thin, and substantially obviates one or more of the problems caused by the limitations and disadvantages of the related art.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by an antenna device particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides the antenna device that is small and thin as summarized below.

[Means for solving the Problem]

The present invention provides the antenna device that is structured by a ground plate, and a feeder unit that extends at a predetermined angle from the ground plate for a predetermined length. Here, the feeder is constituted by a half-body, which is one of two halves of a body divided by a plane that is perpendicular to the ground plate, and the feeder unit is prepared perpendicular to the ground plate.

[Effect of the Invention]

In this manner, the antenna device structured by the ground plate and the feeder of the half-body according to the present invention is small and thin.

DESCRIPTION OF THE PREFERRED EMBODIMENTS

In the following, embodiments of the present invention are described with reference to the accompanying drawings.

[Best Mode of Carrying Out the Invention]

The First Embodiment

Figure 1A:
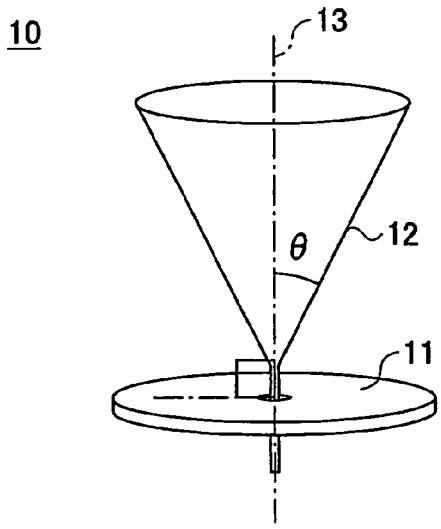
FIG.1A PRIOR ART
FIGS. 1A and 1B are schematic diagrams of conventional antenna devices.
Figure 1B:
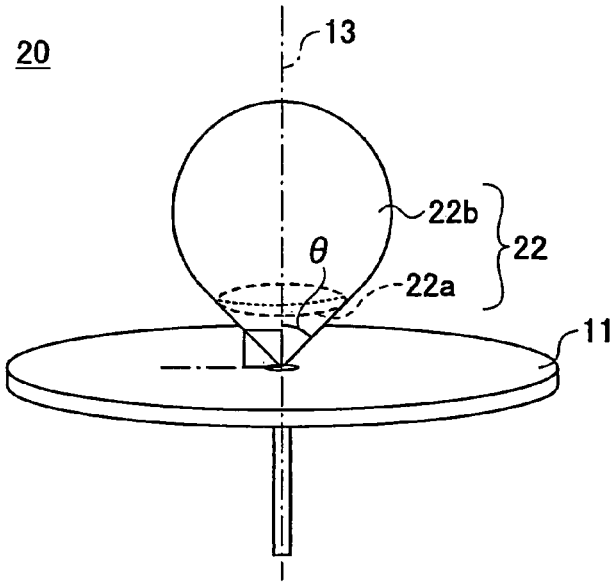
FIG.1B PRIOR ART
Figure 2:
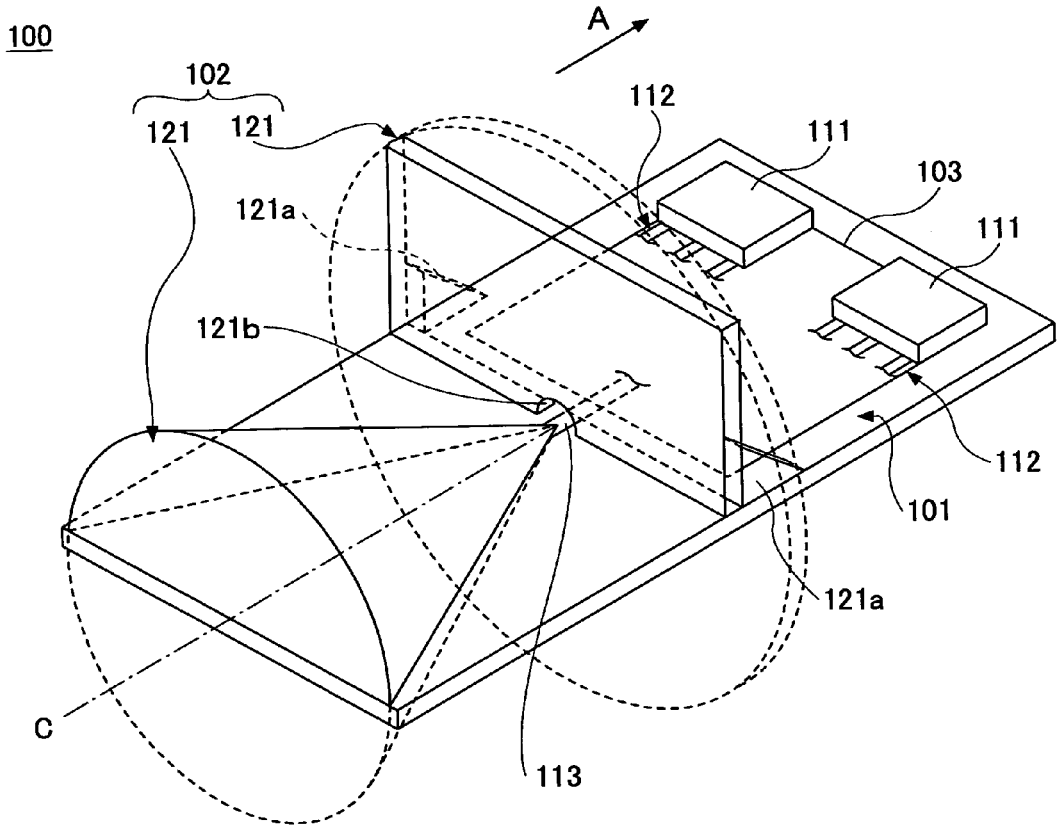
FIG. 2 is a perspective diagram showing an antenna device according to the first embodiment of the present invention.
Figure 3B:
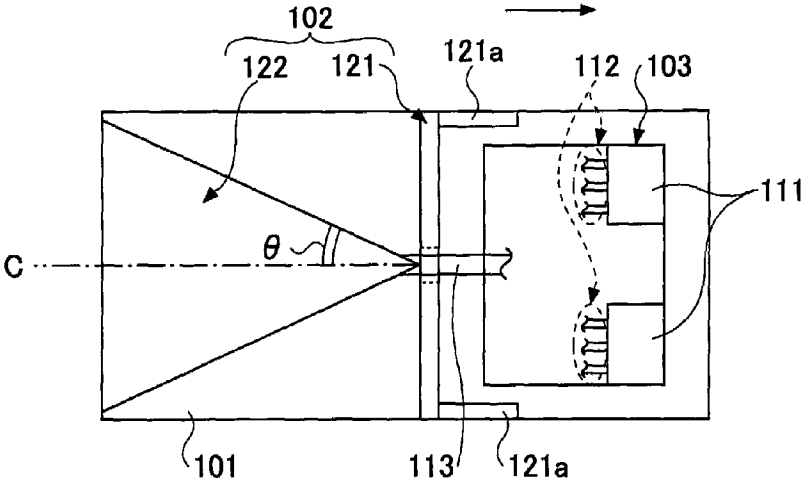
FIGS. 3A, 3B and 3C show top, front, and side views of the antenna device according to the first embodiment of the present invention.
Figure 3C:
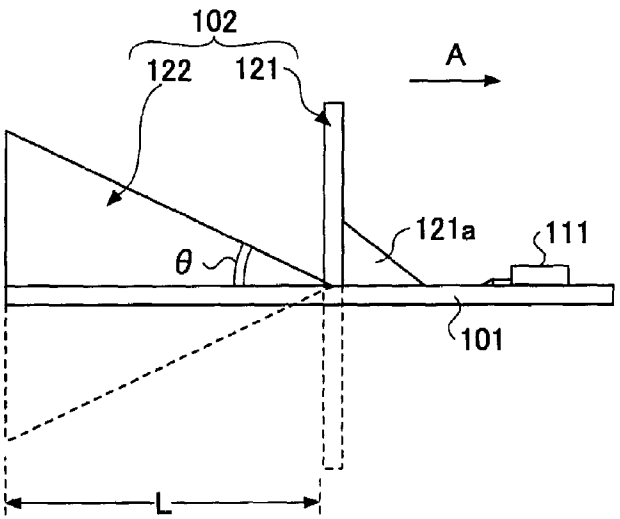
Figure 3A:
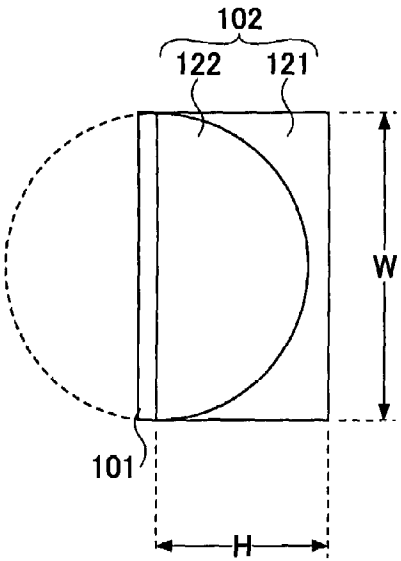

FIG. 2 is a perspective diagram of the antenna device according to the first embodiment of the present invention, and FIGS. 3A, 3B and 3C show top, front, and side views of the first embodiment of the present invention.

An antenna device 100 of the first embodiment includes a dielectric substrate 101, an antenna section 102, and an RF circuit section 103.

The dielectric substrate 101 is made of a dielectric material, such as resin and ceramics, and includes electronic parts 111 that are mounted on the surface of the dielectric substrate 101. The electronic parts 111 are connected to electrically conductive patterns 112 formed on the dielectric substrate 101, and constitute the RF circuit section 103. The RF circuit section 103 is connected to the antenna section 102 by a feeder pattern 113 formed on the dielectric substrate 101.

The antenna section 102 includes a ground plate 121 and a feeding unit 122.

The ground plate 121 is made of a metal plate, and is in the shape of a rectangle. One side of the ground plate 121 is soldered to the dielectric substrate 101, and is connected to the electrically conductive pattern 112 formed on the dielectric substrate 101 such that the ground plate 121 takes the ground potential.

At both ends of the side of the ground plate 121, the side being soldered, support sections 121*a* are formed in one body. The support sections 121*a* are bent in the direction of an arrow A, which is perpendicular to the ground plate 121. The support sections 121*a* are soldered to the dielectric substrate 101, and support the ground plate 121 in the erect state (nominally perpendicular to the dielectric substrate 101).

Further, a cutout 121*b* is formed near the central part of the side of the ground plate 121, which side is soldered to the dielectric substrate 101. The feeder pattern 113 passes through the cutout 121*b*. The feeding unit 122 is soldered to the feeder pattern 113.

The feeding unit 122 is made of an electrically conductive material, such as metal, and is shaped in the form of a half-body of a circular cone. The half-body of the circular cone is one of two halves of the circular cone divided by a plane that is perpendicular to the base, the plane passing through the peak (apex) of the circular cone. The feeding unit 122 is soldered to the dielectric substrate 101 such that the plane faces the dielectric substrate 101. Further, the peak portion of the feeding unit 112 is connected to the feeder pattern 113.

For UWB communications at the 3.1–10.6 GHz band, the feeding unit 122 is arranged such that an angle θ to a center line C ranges between 40 and 80 degrees, and a length L is about 25 mm. Here, the length L is set at about a quarter of the wavelength (λ/4) of the receiving frequency.

Height H and width W of the ground plate 121 are set up so as to be slightly greater than the corresponding dimensions of the base of the feeding unit 122.

By setting up the antenna device as described above, a peak value of VSWR can be made smaller than 3.0 in the 3.1–10.6 GHz range, which is the frequency band of UWB.

According to the first embodiment, the antenna device 100 is made small and thin by constituting the feeding unit 122 by the half-body of the circular cone, as compared with the conventional antenna device where the feeding unit 122 is constituted by a whole circular cone.

In addition, the feeding unit 122 may be of a hollow structure such that the weight is decreased.

The Second Embodiment

Figure 4:
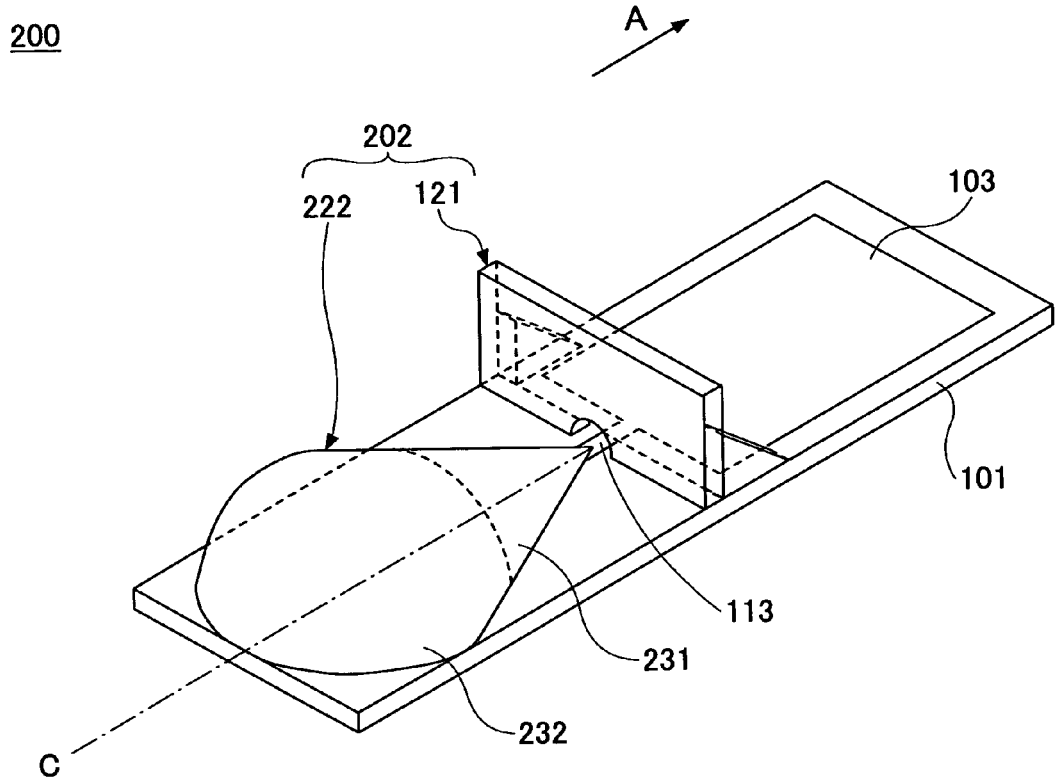
FIG. 4 is a perspective diagram of the antenna device according to the second embodiment of the present invention.
Figure 5B:
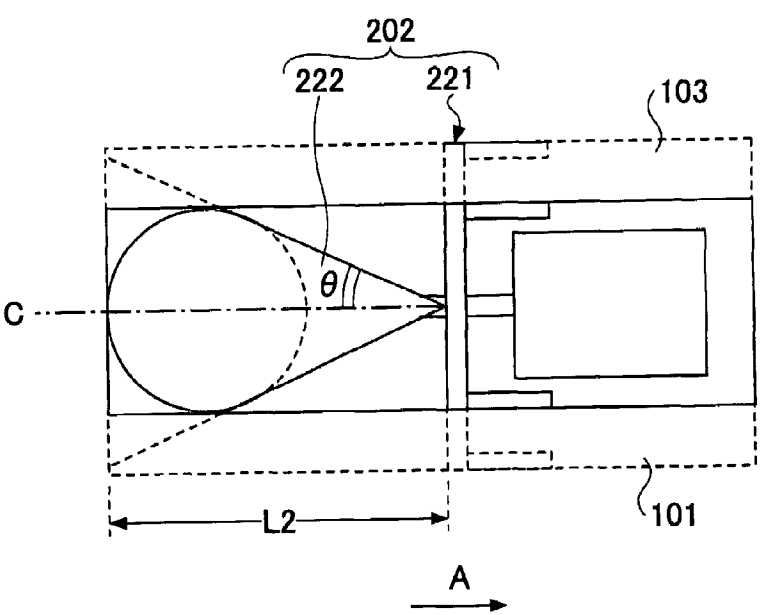
FIGS. 5A, 5B and 5C show top, front, and side views of the antenna device according to the second embodiment of the present invention.
Figure 5C:
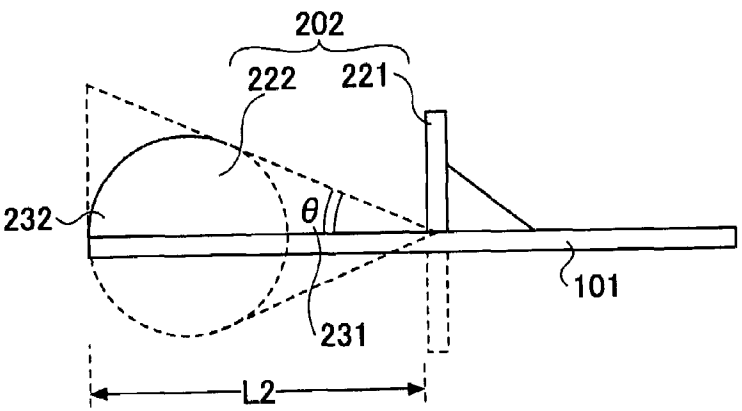
Figure 5A:
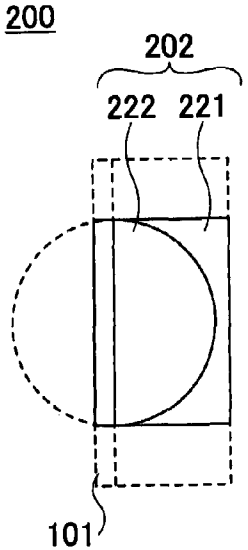

FIG. 4 is a perspective diagram of an antenna device 200 according to the second embodiment of the present invention, and FIGS. 5A, 5B and 5C show top, front, and side views of the second embodiment of the present invention. In FIG. 4 and FIGS. 5A, 5B and 5C, the same reference marks are given to the same components as FIG. 2 and FIGS. 3A, 3B and 3C, and explanations thereof are not repeated.

The antenna device 200 includes an antenna section 202 that is different from the first embodiment. Further, the antenna section 202 includes a feeding unit 222 that is different from the form of the feeding unit 122 of the first embodiment.

The feeding unit 222 consists of a circular cone section 231 and a sphere section 232, both being formed in one body. The circular cone section 231 is substantially made in the same shape as the feeding section 122 of the first embodiment, except that the length of the circular cone section 231 is shorter. The sphere section 232 is inscribed in the circular cone section 231.

For UWB communication at the 3.1–10.6 GHz band, the feeding unit 222 is set up such that a length L2 that is a sum of the lengths of the circular cone section 231 and the sphere section 232 is about 25 mm, and the angle θ to the centerline C ranges between 40 and 80 degrees.

The dimensions of the ground plate 121 are set slightly greater than the projection form of the feeding unit 222 in the direction of the arrow A.

Since the feeding unit 222 is constituted by the circular cone section 231 and the sphere section 232 according to this embodiment, the feeding unit 222 is made small and thin, and the antenna device 200 can be made small and thin.

The Third Embodiment

Figure 6:
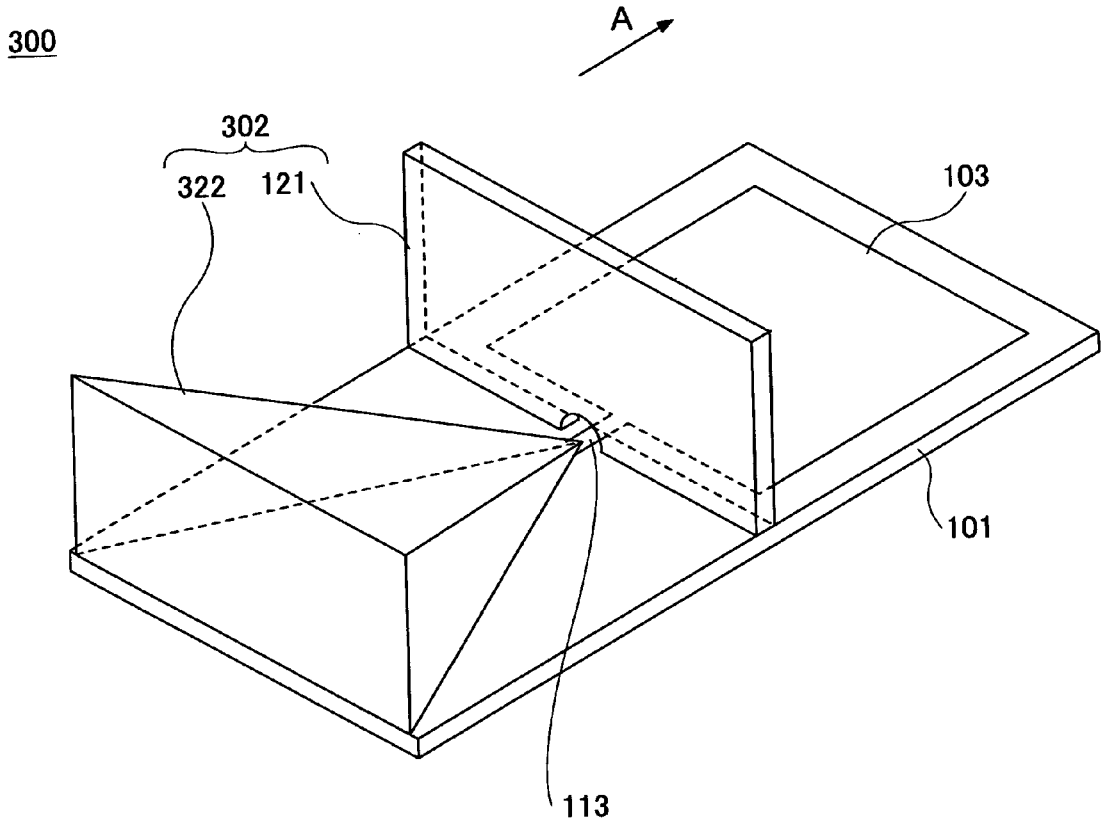
FIG. 6 is a perspective diagram of the antenna device according to the third embodiment of the present invention.
Figure 7B:
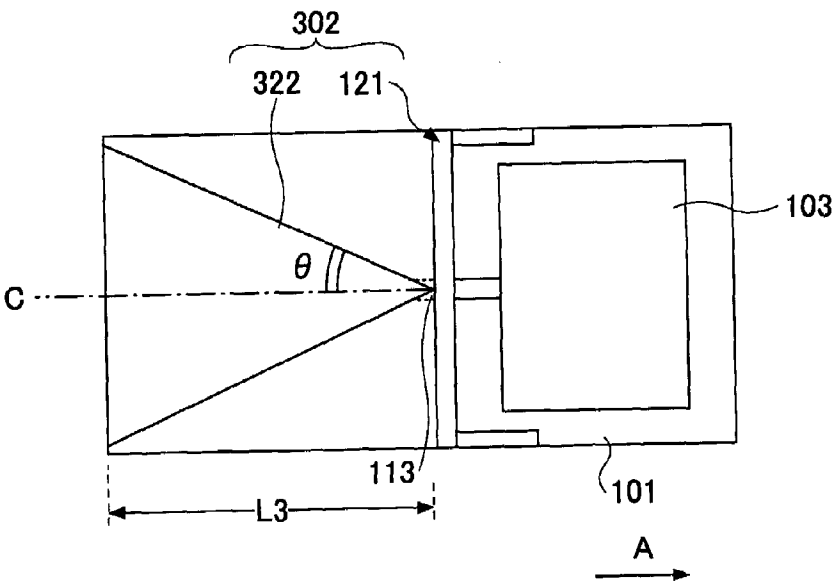
FIGS. 7A, 7B and 7C show top, front, and side view of the antenna device according to the third embodiment of the present invention.
Figure 7C:
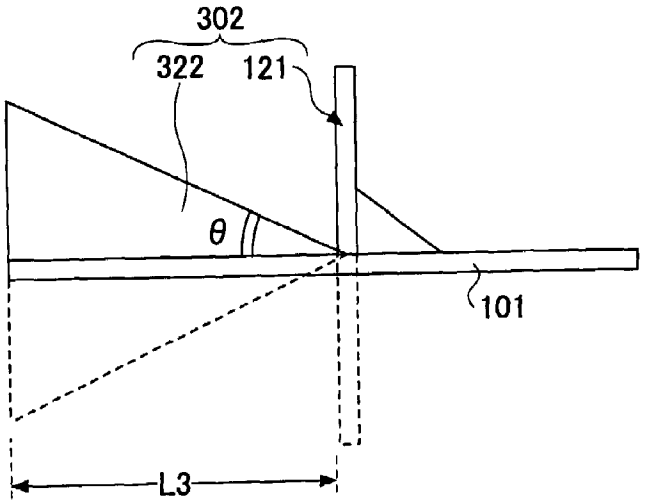
Figure 7A:
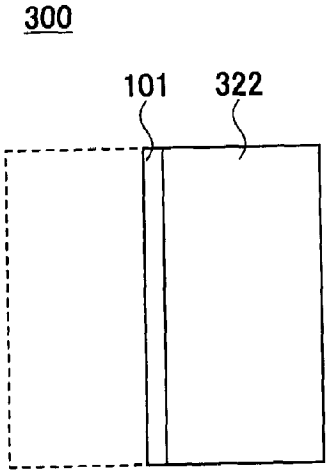

FIG. 6 is a perspective diagram of an antenna device 300 according to the third embodiment of the present invention, and FIGS. 7A, 7B and 7C show top, front, and side views of the third embodiment of the present invention. In FIG. 6 and FIGS. 7A, 7B and 7C, the same reference marks are given to the same components as FIG. 2 and FIGS. 3A, 3B and 3C, and explanations thereof are not repeated.

The antenna device 300 includes an antenna section 302 that is different from the first embodiment. Further, the antenna section 302 includes a feeding unit 322 that is shaped different from the form of the feeding unit 122 of the first embodiment.

The shape of the feeding unit 322 is a half-body of a rectangular pyramid, the vertex of which is connected to the feeder pattern 113.

For UWB communications in the 3.1–10.6 GHz band, the feeding unit 322 is set up so that a length L3 is 25 mm, and the angle θ to the centerline C of each side ranges between 40 and 80 degrees, more specifically 63 degrees. Here, an angle between the centerline C and a ridgeline may be set up at 63 degrees.

Further, the ground plate 121 is set to be greater than the projection form grade of the direction of arrow A of the feeding unit 322.

According to this embodiment, compared with the conventional case where the feeding unit 322 may be constituted by a whole rectangular pyramid, the feeding unit 322 can be made small and thin by constituting the feeding unit 322 by the half-body of the rectangular pyramid, and the antenna device 300 can be made small and thin.

Here, the feeding unit 322 may be of a hollow structure such that the antenna device 300 is made light-weight.

The Fourth Embodiment

Figure 8:
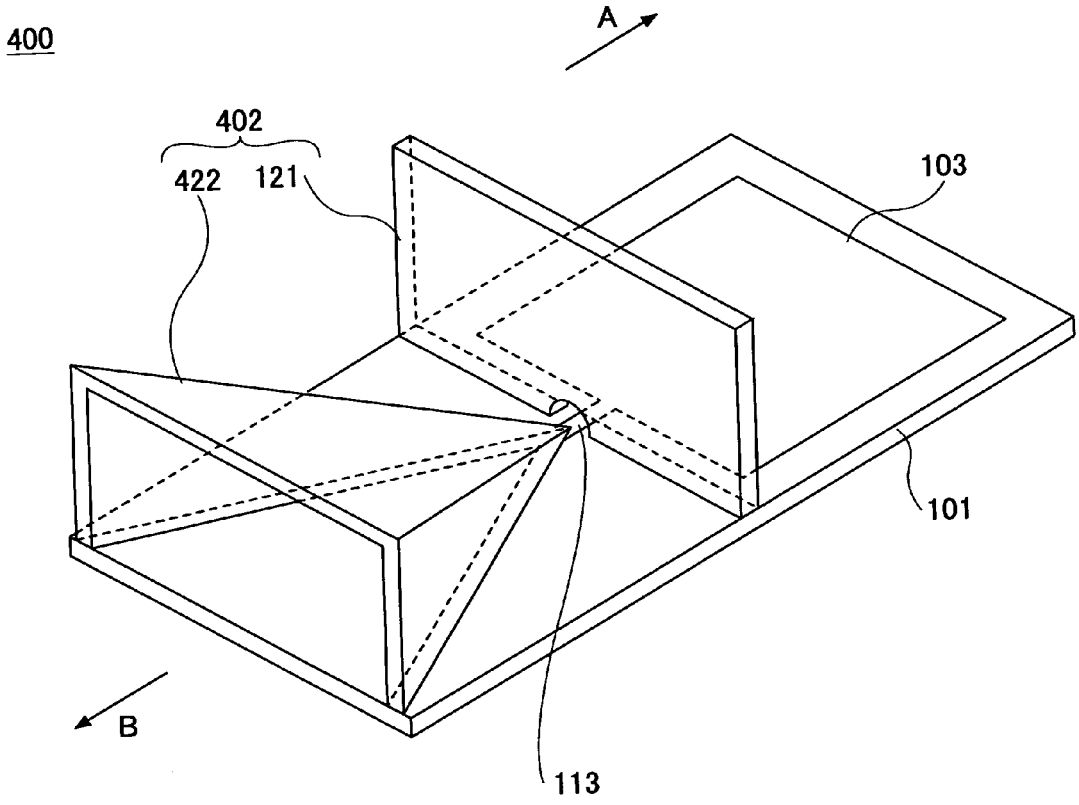
FIG. 8 is a perspective diagram of the antenna device according to the fourth embodiment of the present invention.
Figure 9B:
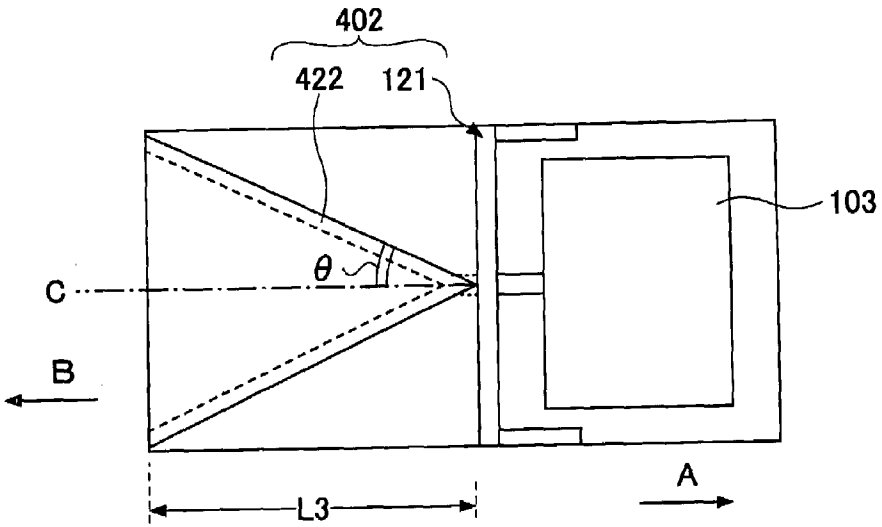
FIGS. 9A, 9B and 9C shows top, front, and side views of the antenna device according to the fourth embodiment of the present invention.
Figure 9C:
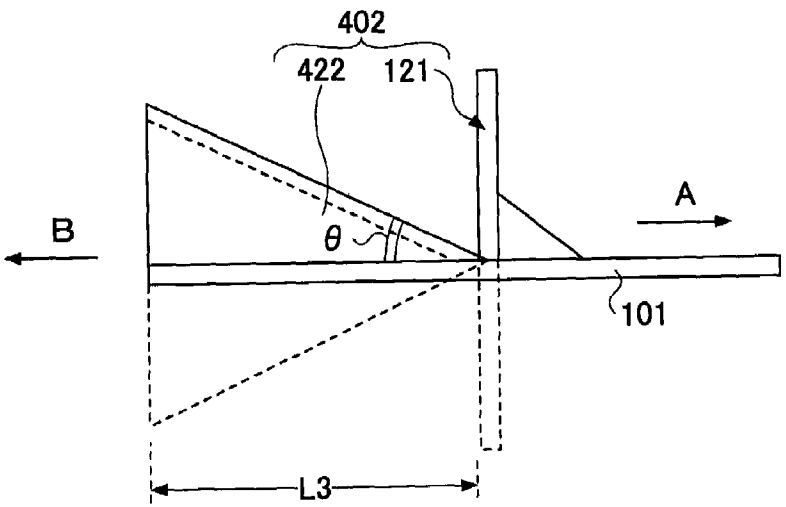
Figure 9A:
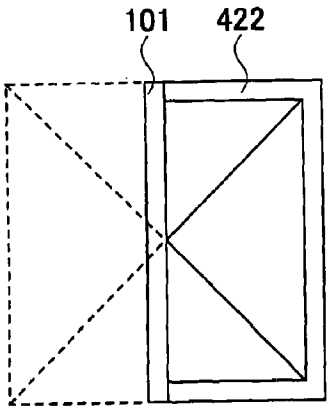

FIG. 8 is a perspective diagram of an antenna device 400 according to the fourth embodiment of the present invention, and FIGS. 9A, 9B and 9C show top, front, and side views of the fourth embodiment of the present invention. In FIG. 8 and FIGS. 9A, 9B and 9C, the same reference marks are given to the same components as FIG. 2 and FIGS. 3A, 3B and 3C, and explanations thereof are not repeated.

The antenna device 400 includes an antenna section 402 that is different from the third embodiment. Further, the antenna section 402 includes a feeding unit 422 that is of a hollow structure, i.e., the base of the feeding unit 422 is opened to the direction shown by an arrow B as compared with the base of the feeding unit 322 of the third embodiment.

According to this embodiment, since the feeding unit 422 has the hollow structure, the antenna device 400 can be made light-weight in comparison with the third embodiment.

Here, although the base of the feeding unit 422 is made open to the direction of the arrow B in this embodiment in order to make fabrication possible by bending a metal plate, it is also possible to make the feeding unit 422 with the base being closed, and the inside being hollow.

The Fifth Embodiment

Figure 10:
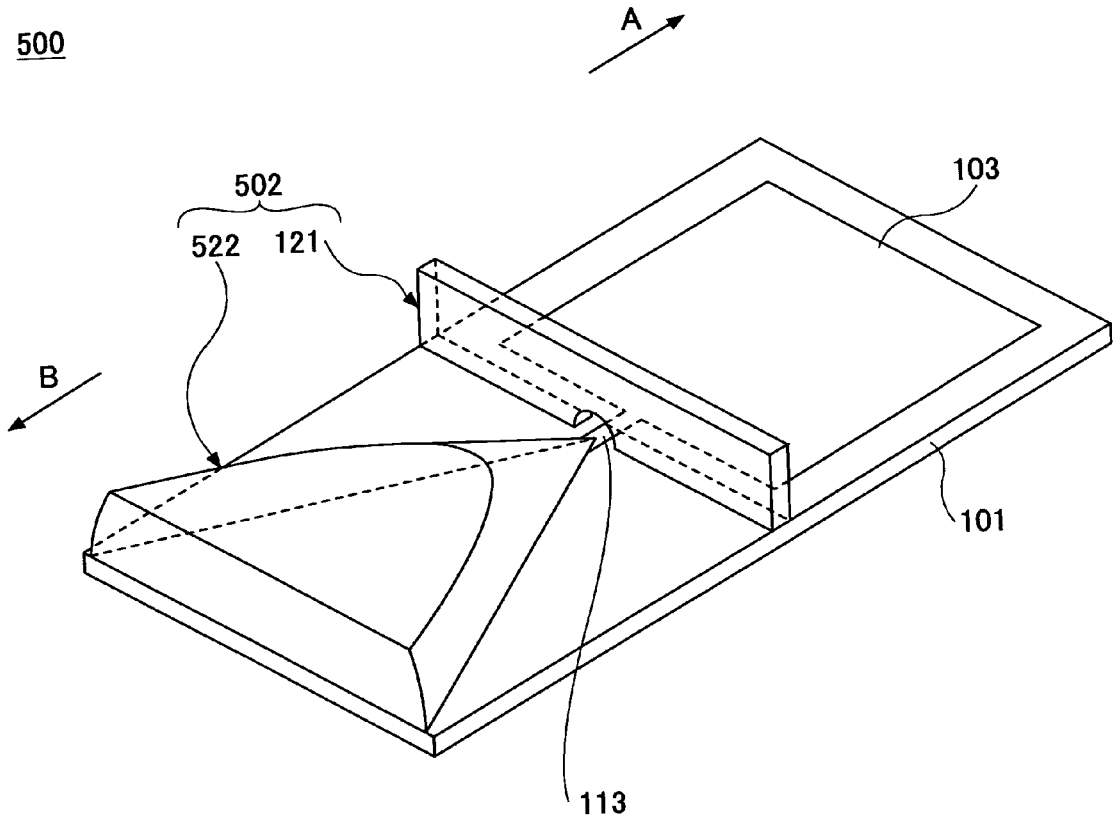
FIG. 10 is a perspective diagram of the antenna device according to the fifth embodiment of the present invention.
Figure 11B:
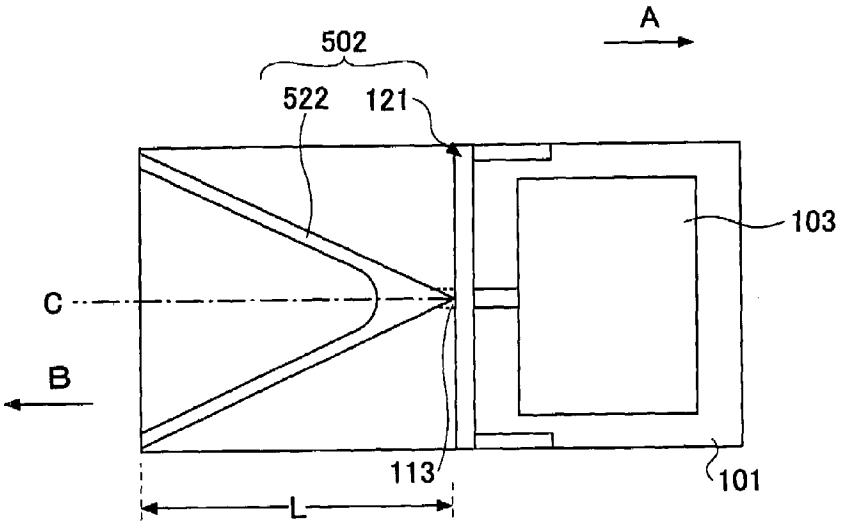
FIGS. 11A, 11B and 11C show top, front, and side views of the antenna device according to the fifth embodiment of the present invention.
Figure 11C:
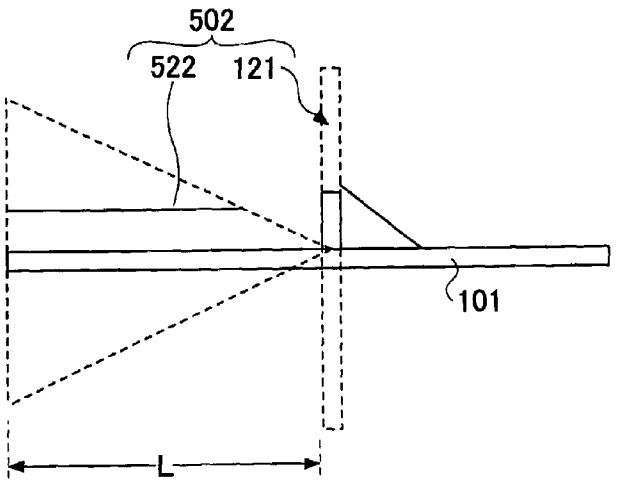
Figure 11A:
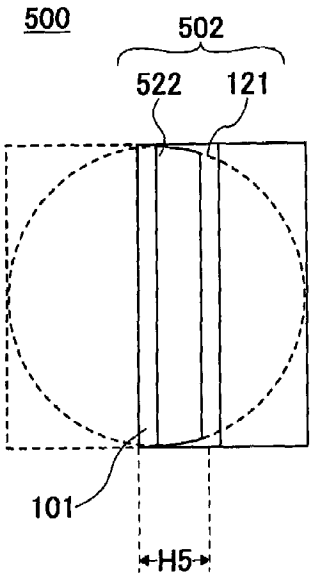

FIG. 10 is a perspective diagram of an antenna device 500 according to the fifth embodiment of the present invention, and FIGS. 11A, 11B and 11C show top, front, and side views of the fifth embodiment of the present invention. In FIG. 10 and FIGS. 11A, 11B and 11C, the same reference marks are shown to the same components as FIG. 2 and FIGS. 3A, 3B and 3C, and explanations thereof are not repeated.

The antenna device 500 includes an antenna section 502 that is different from the first embodiment. The antenna section 502 includes a feeding unit 522 having a shape different from the shape of the feeding unit 122 of the first embodiment.

The feeding unit 522 of this embodiment is made into the form where the feeding unit 122 of the first embodiment is cut by a plane parallel to the dielectric substrate 101. Further, the dimensions of the ground plate 121 are arranged slightly greater than the projection form of the feeding unit 522 in the direction of the arrow A.

According to this embodiment, compared with the antenna device 100 of the first embodiment, the antenna device 500 can be made thinner by making the feeding unit 522 thinner.

In addition, the feeding unit 522 may be of a hollow structure such that the antenna device 500 can be made light-weight.

The Sixth Embodiment

Figure 12:
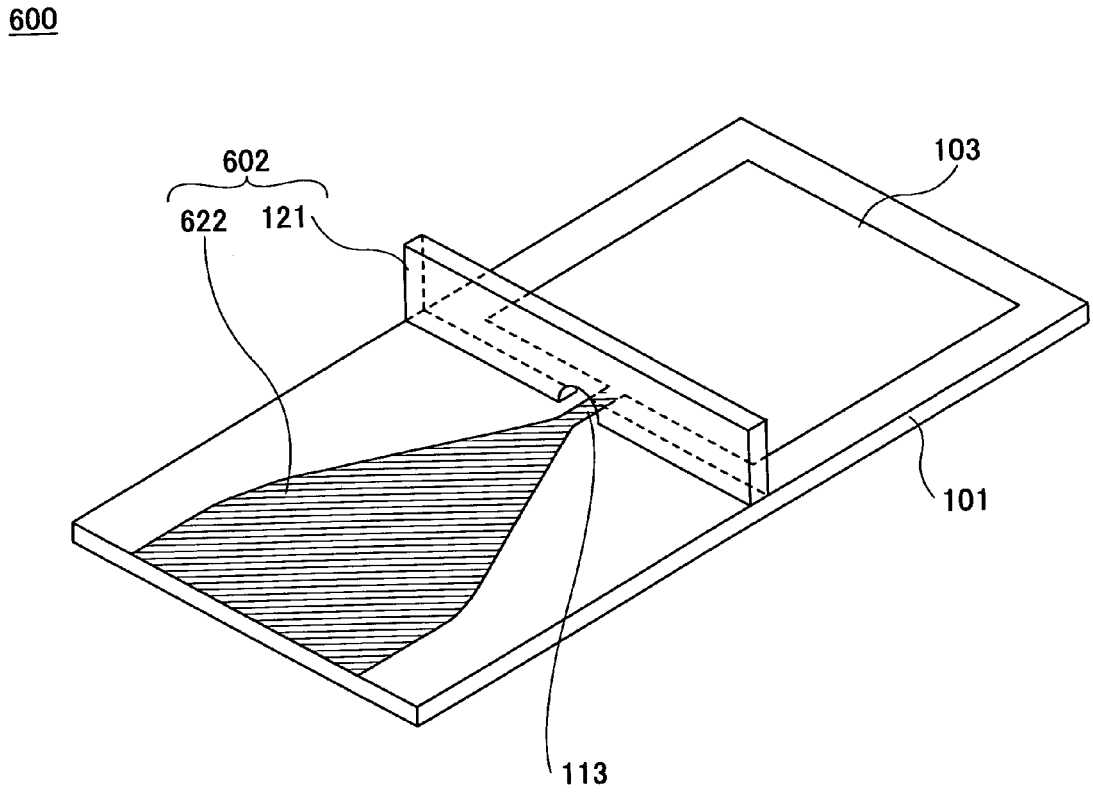
FIG. 12 is a perspective diagram of the antenna device according to the sixth embodiment of the present invention.
Figure 13B:
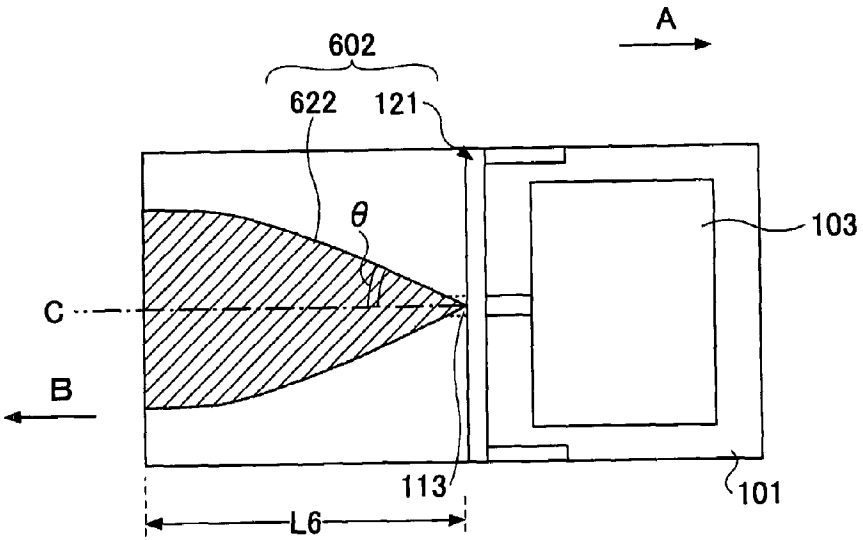
FIGS. 13A, 13B and 13C show top, front, and side views of the antenna device according to the sixth embodiment of the present invention.
Figure 13C:
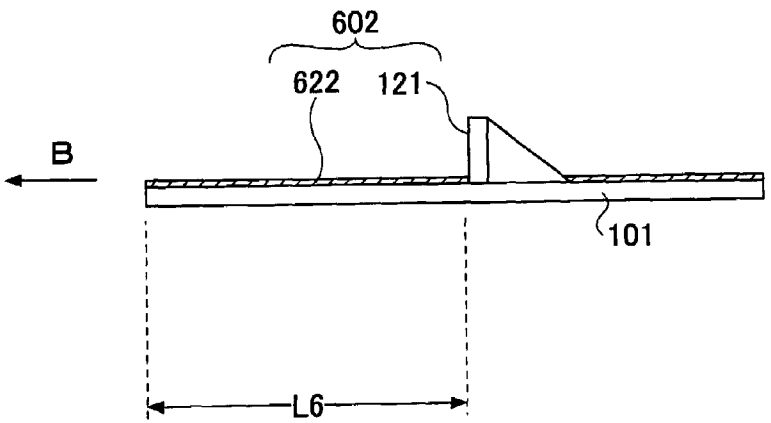
Figure 13A:
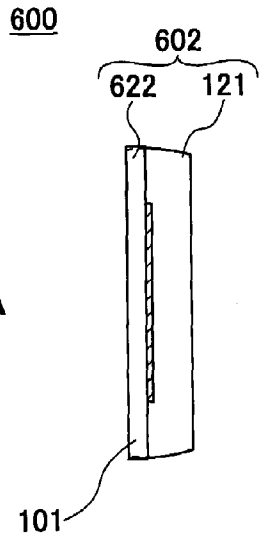

FIG. 12 is a perspective diagram of an antenna device 600 according to the sixth embodiment of the present invention, and FIGS. 13A, 13B and 13C show top, front, and side views of the sixth embodiment of the present invention. In FIG. 12 and FIGS. 13A, 13B and 13C, the same reference marks are given to the same components as FIG. 2 and FIGS. 3A, 3B and 3C, and explanations thereof are not repeated.

The antenna device 600 includes an antenna section 602 that is different from the first embodiment. The antenna section 602 includes a feeding unit 622 that is formed by an electrically conductive pattern on the dielectric substrate 101.

The electrically conductive pattern that constitutes the feeding unit 622 is made by an electrically conductive material with a thickness of about 35 μm, and is formed in the shape of a fan. For UWB communication at the 3.1–10.6 GHz band, the angle θ of the fan from the centerline C is set to range between 40 and 80 degrees, and a length L6 is set to about 25 mm.

According to this embodiment, the antenna device 600 can be made thinner than the antenna device 100 of the first embodiment by constituting the feeding unit 622 by the electrically conductive pattern.

The Seventh Embodiment

Figure 14:
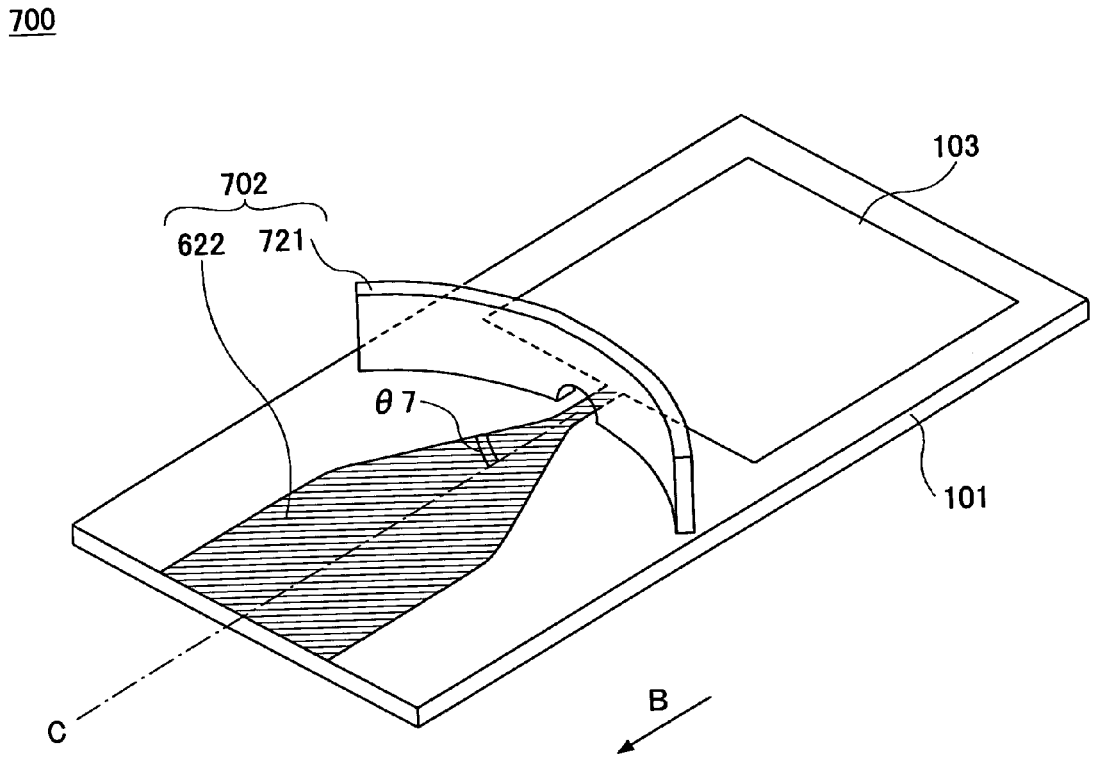
FIG. 14 is a perspective diagram of the antenna device according to the seventh embodiment of the present invention.
Figure 15B:
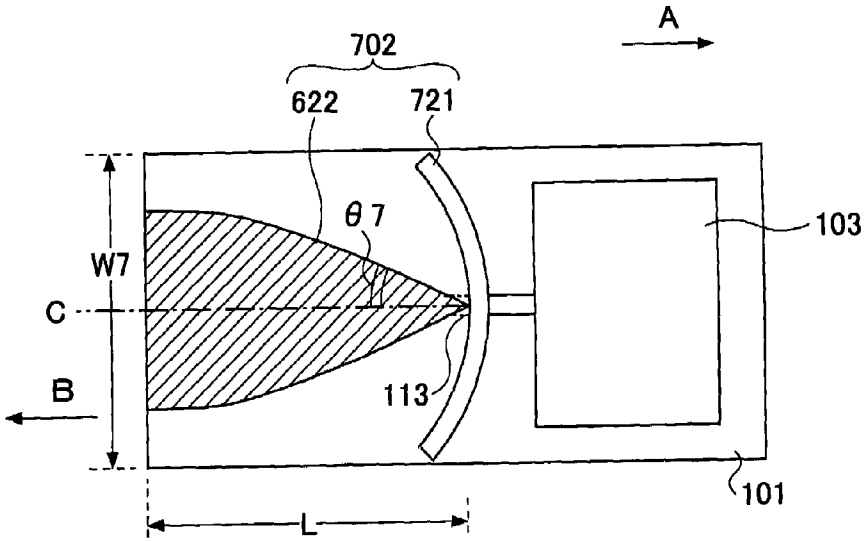
FIGS. 15A, 15B and 15C show top, front, and side views of the antenna device according to the seventh embodiment of the present invention.
Figure 15C:
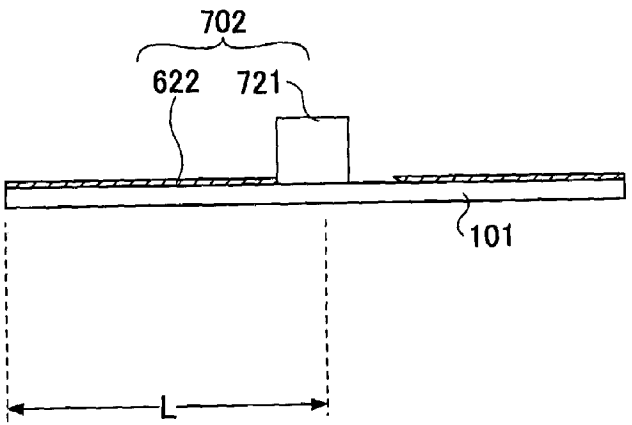
Figure 15A:
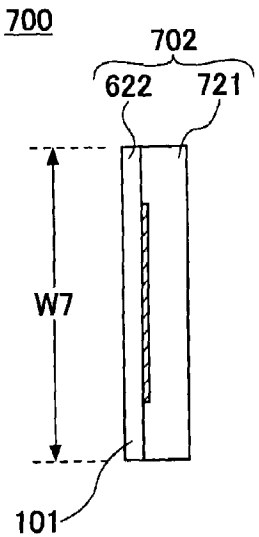

FIG. 14 is a perspective diagram of an antenna device 700 according to the seventh embodiment of the present invention, and FIGS. 15A, 15B and 15C show top, front, and side views of the seventh embodiment of the present invention.

In FIG. 14 and FIGS. 15A, 15B and 15C, the same reference marks are given to the same components as FIG. 12 and FIGS. 13A, 13B and 13C, and explanations thereof are not repeated.

The antenna device 700 includes an antenna section 702 that is different from the sixth embodiment. Further, the antenna section 702 includes a ground plate 721 that is curved such that two ends of the ground plate 721 protrude toward the feeding unit 622 in the direction of the arrow B in reference to the central part that is made concave.

According to this embodiment, transmission and reception efficiency is raised. Further, an angle θ7 at the connecting portion of the feeding unit 622 with the feeder pattern 113 can be made small. In this manner, width of the feeding unit 622 can be made small, and, accordingly, the antenna device 700 can be made small.

The Eighth Embodiment

Figure 16:
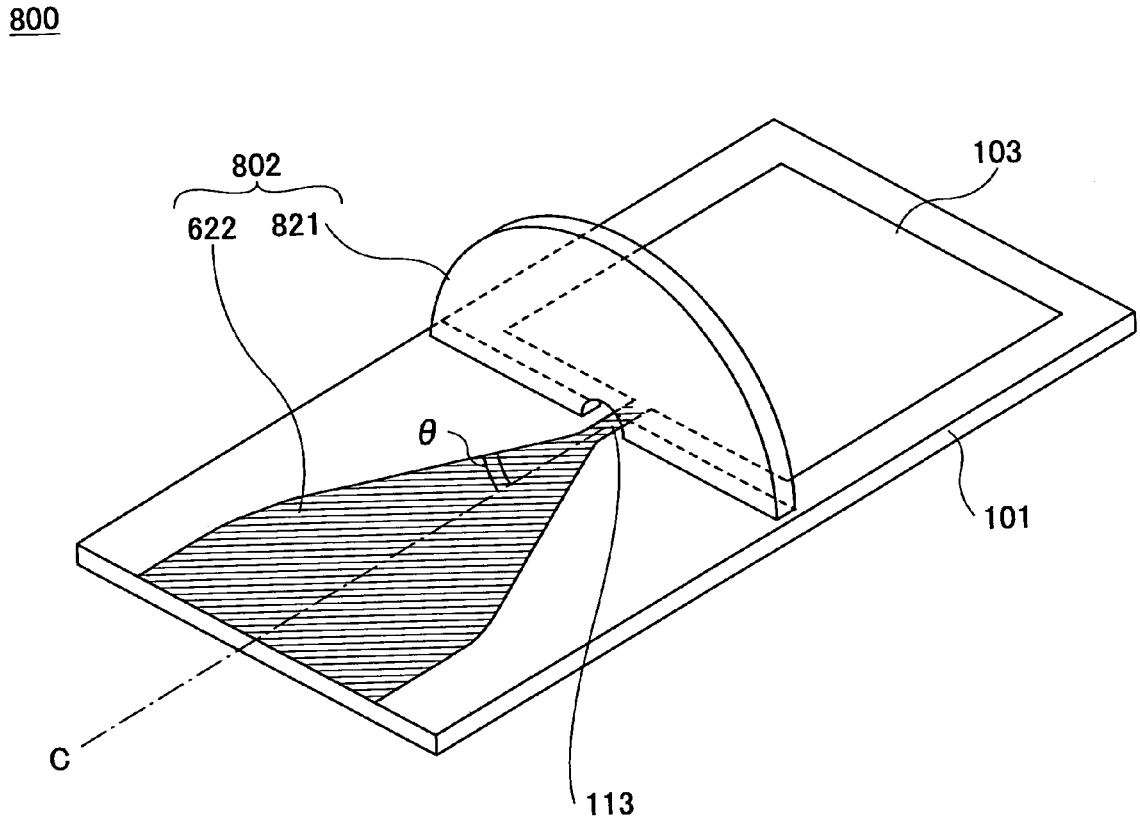
FIG. 16 is a perspective diagram of the antenna device according to the eighth embodiment of the present invention.
Figure 17B:
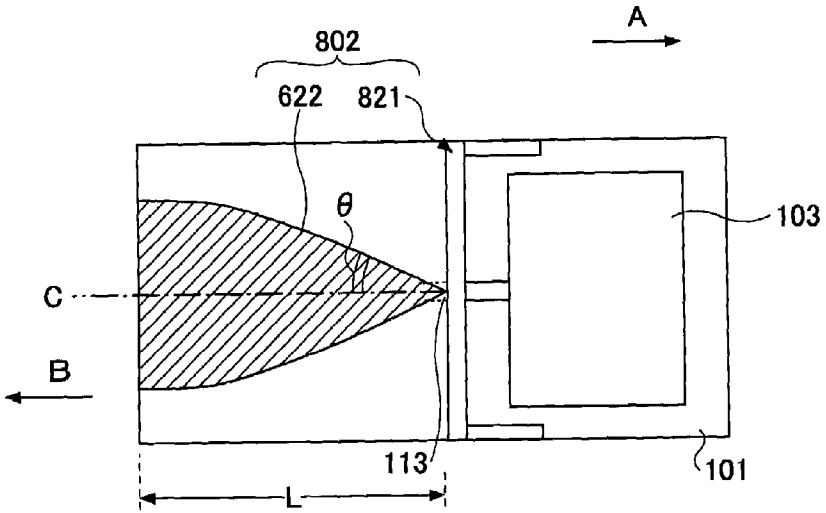
FIGS. 17A, 17B and 17C show top, front, and side views of the antenna device according to the eighth embodiment of the present invention.
Figure 17C:
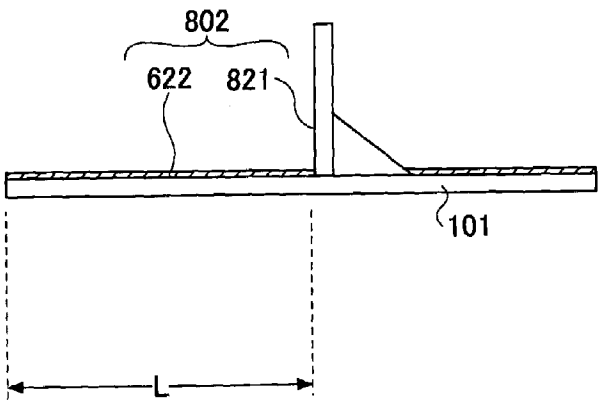
Figure 17A:
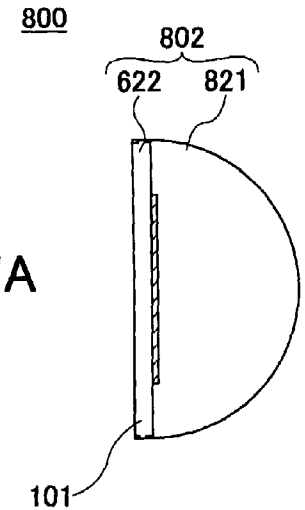

FIG. 16 is a perspective diagram of an antenna device 800 according to the eighth embodiment of the present invention, and FIGS. 17A, 17B and 17C show top, front, and side views of the eighth embodiment of the present invention. In FIG. 16 and FIGS. 17A, 17B and 17C, the same reference marks are given to the same components as FIG. 12 and FIGS. 13A, 13B and 13C, and explanations thereof are not repeated.

The antenna device 800 includes an antenna section 802 that is different from the sixth embodiment. The antenna section 802 includes a ground plate 821 that is formed in the shape of a semicircle.

According to this embodiment, transmission and reception efficiency is raised.

The Ninth Embodiment

Figure 18:
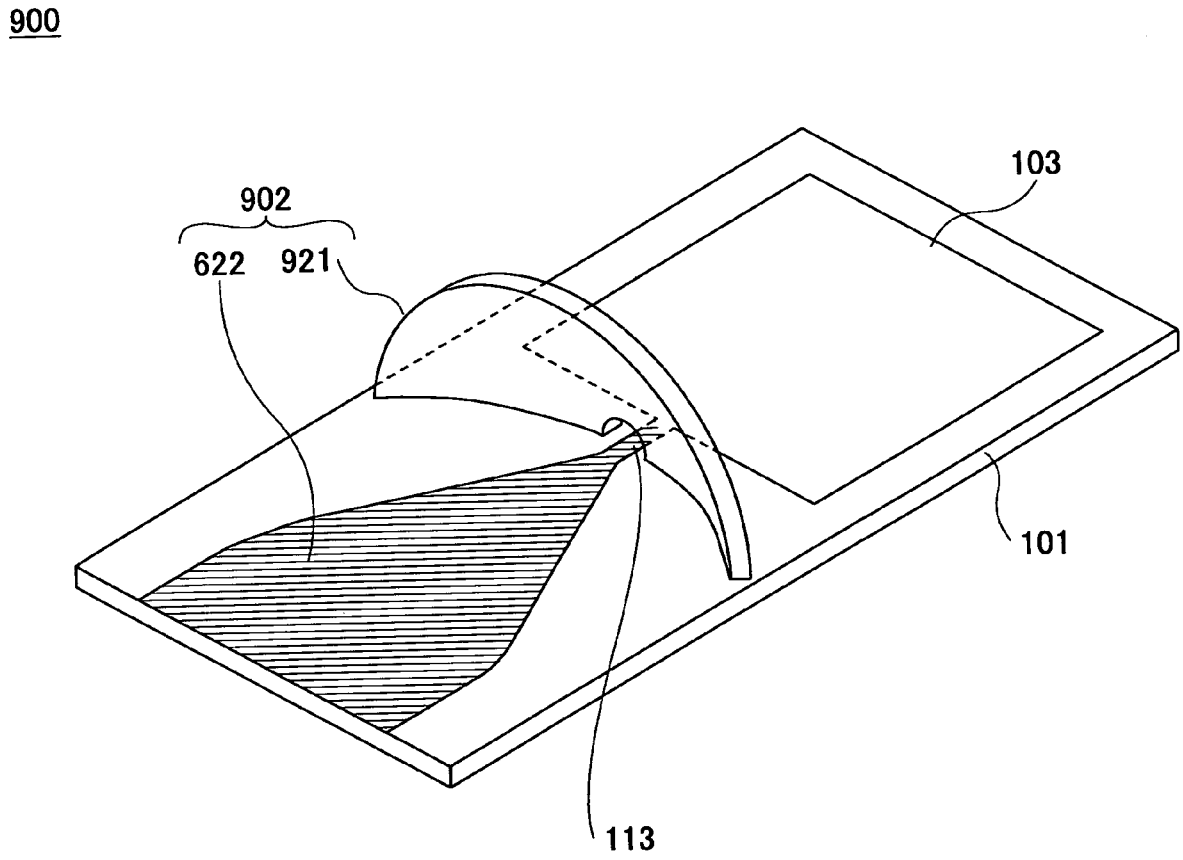
FIG. 18 is a perspective diagram of the antenna device according to the ninth embodiment of the present invention.
Figure 19B:
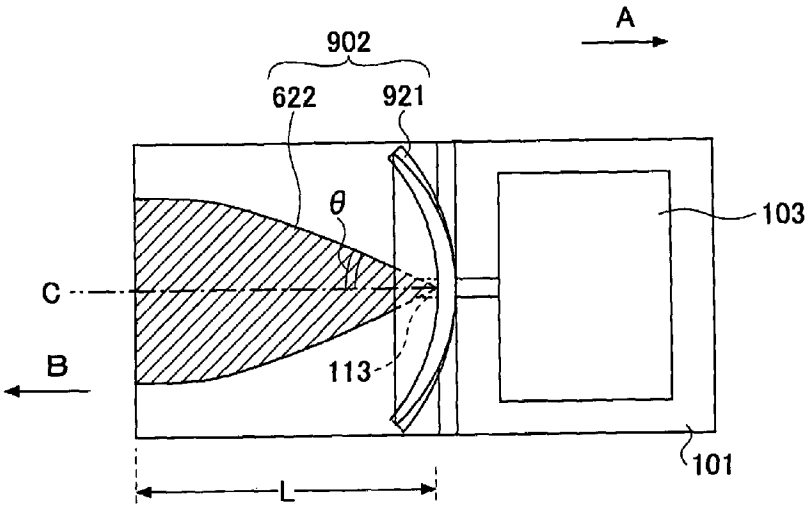
FIGS. 19A, 19B and 19C show top, front, and side views of the antenna device according to the ninth embodiment of the present invention.
Figure 19C:
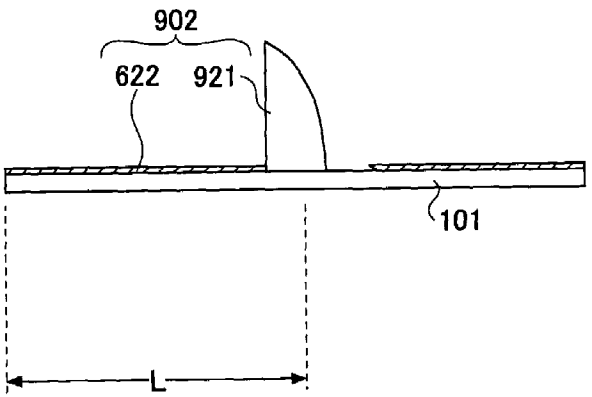
Figure 19A:
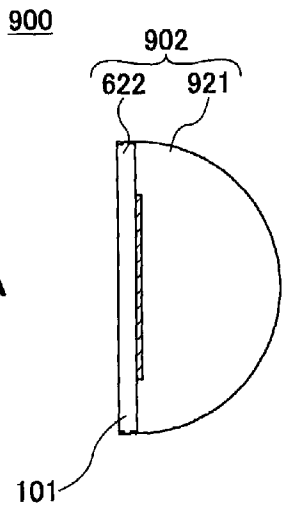

FIG. 18 is a perspective diagram of an antenna device 900 according to the ninth embodiment of the present invention, and FIGS. 19A, 19B and 19C show top, front, and side views of the ninth embodiment of the present invention. In FIG. 18 and FIGS. 19A, 19B and 19C, the same reference marks are given to the same components as FIG. 12 and FIGS. 13A, 13B and 13C, and explanations thereof are not repeated.

The antenna device 900 includes an antenna section 902 that is different from the sixth embodiment. The antenna section 902 includes a ground plate 921 that is formed by a half-body of a parabolic shape with the two ends of the ground plate 921 being protruded in the direction of the feeding unit 622, and the direction of the arrow B in reference to the central part of the ground plate 921.

According to this embodiment, transmission and reception efficiency is further enhanced as compared with the eighth embodiment. Further, the antenna device 902 provides enhanced directivity.

The Tenth Embodiment

Figure 20:
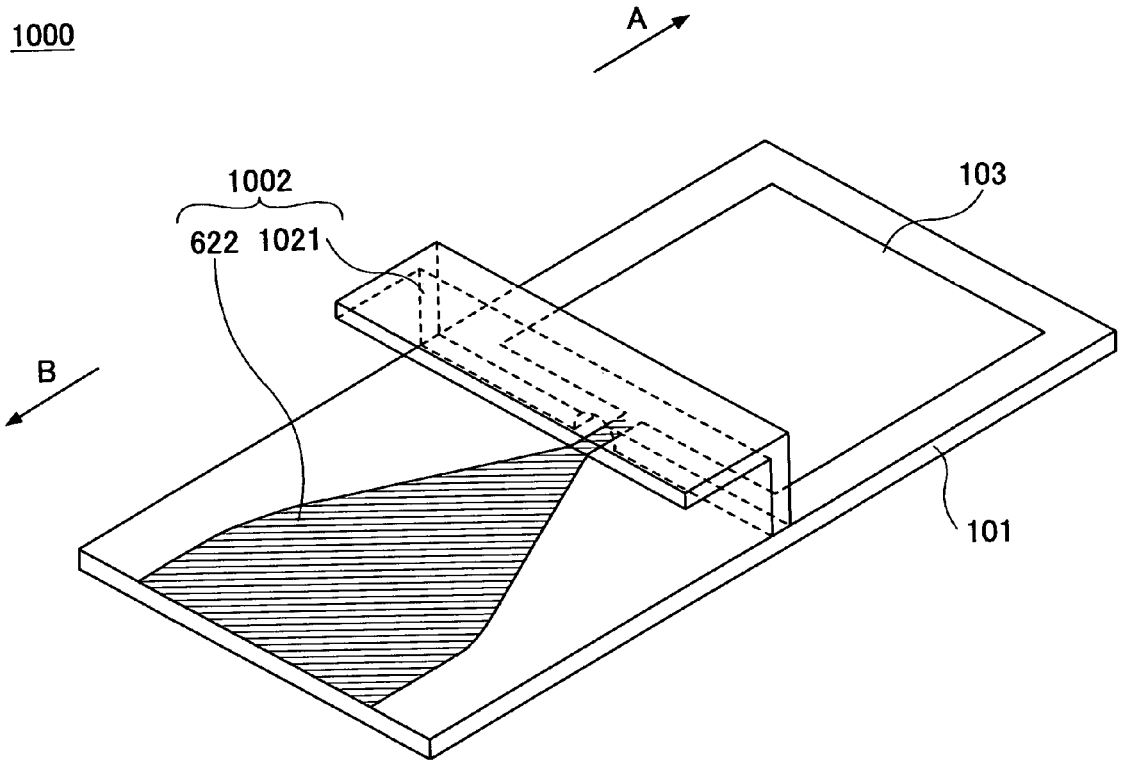
FIG. 20 is a perspective diagram of the antenna device according to the tenth embodiment of the present invention.
Figure 21B:
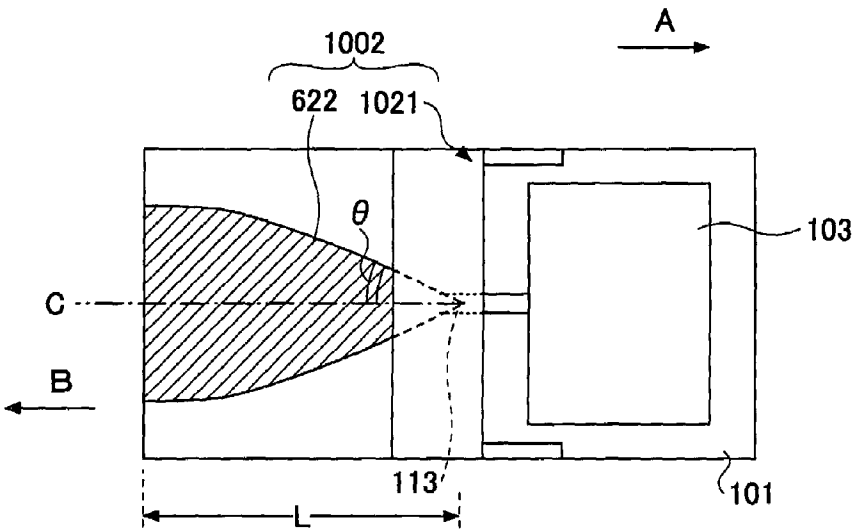
FIGS. 21A, 21B and 21C show top, front, and size views of the antenna device according to the tenth embodiment of the present invention.
Figure 21C:
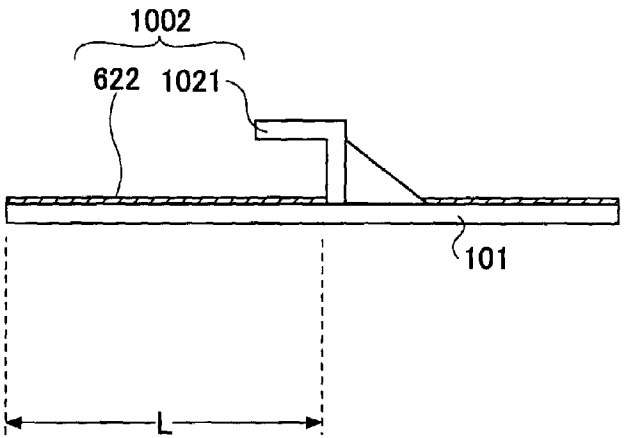
Figure 21A:
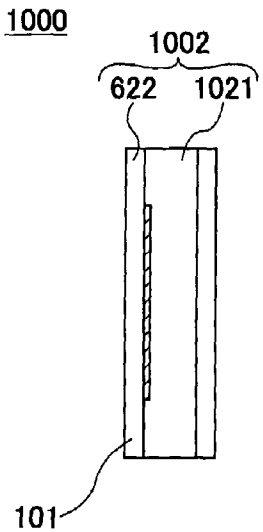

FIG. 20 is a perspective diagram of an antenna device 1000 according to the tenth embodiment of the present invention, and FIGS. 21A, 21B and 21C show top, front, and side views of the tenth embodiment of the present invention. In FIG. 20 and FIGS. 21A, 21B and 21C, the same reference marks are given to the same components as FIG. 12 and FIGS. 13A, 13B and 13C, and explanations thereof are not repeated.

The antenna device 1000 includes an antenna section 1002 that is different from the sixth embodiment. Further, the antenna section 1002 includes a ground plate 1021. The ground plate 1021 is the same as the ground plate 121 except that it has a roof-like structure extended from the upper edge, the roof-like structure extending in the direction of the feeding unit 622, and the direction of the arrow B.

According to this embodiment, the antenna device 1000 has enhanced directivity.

The 11th Embodiment

Figure 22:
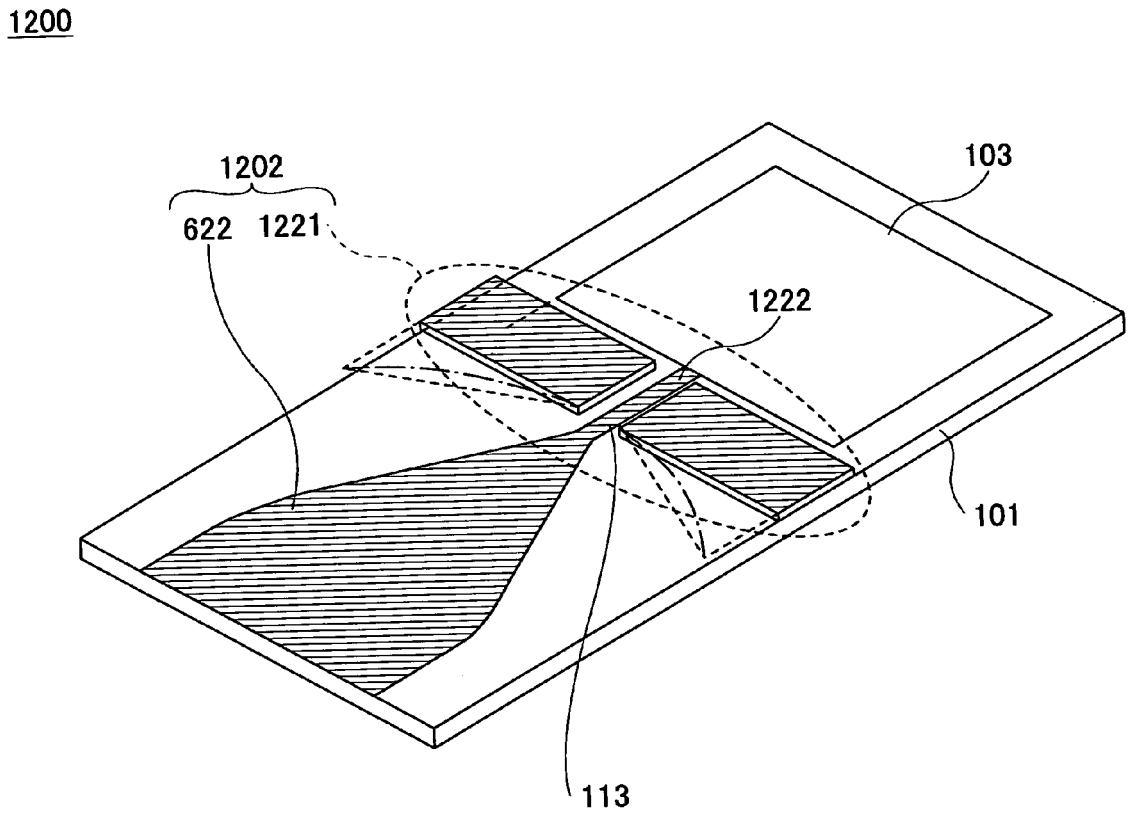
FIG. 22 is a perspective diagram of the antenna device according to the 11th embodiment of the present invention.
Figure 23B:
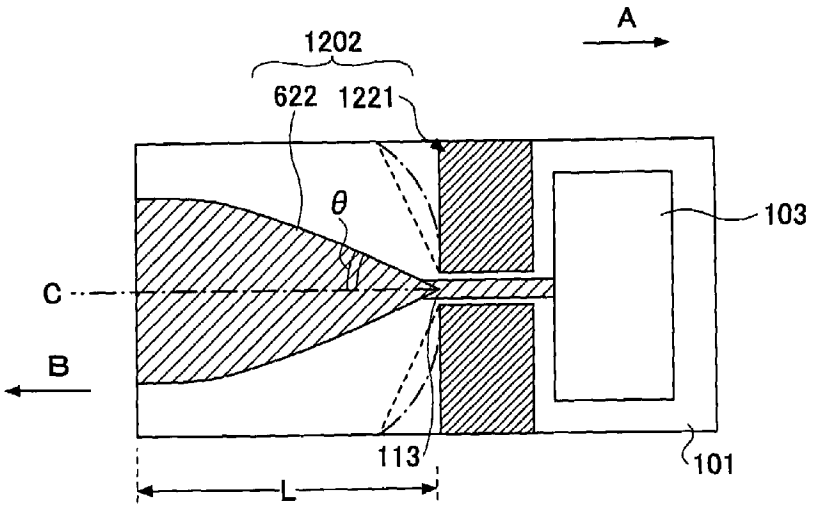
FIGS. 23A, 23B and 23C shows top, front, and side views of the antenna device according to the 11th embodiment of the present invention.
Figure 23C:
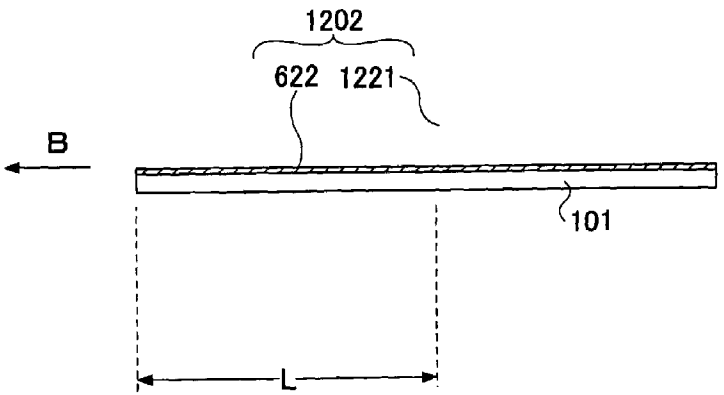
Figure 23A:
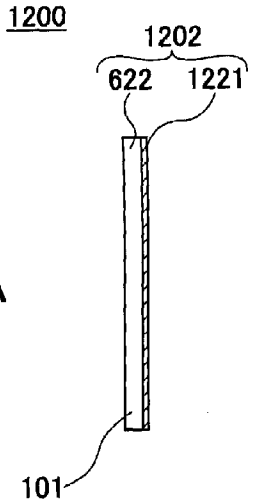

FIG. 22 is a perspective diagram of an antenna device 1200 according to the 11th embodiment of the present invention, and FIGS. 23A, 23B and 23C show top, front, and side views of the 11th embodiment of the present invention. In FIG. 22 and FIGS. 23A, 23B and 23C, the same reference marks are given to the same components as FIG. 12 and FIGS. 13A, 13B and 13C, and explanations thereof are not repeated.

The antenna device 1200 includes an antenna section 1202 that is different from the sixth embodiment. Further, the antenna section 1202 includes a ground plate 1221 constituted by an electrically conductive pattern formed on the dielectric substrate 101. Further, a penetration section 1222 is formed at the central part of the ground plate 1221 such that the feeder pattern 113 connects the antenna section 1202 and the RF circuit section 103.

According to this embodiment, since the ground plate 1221 is an electrically conductive pattern, the antenna device 1200 can be made thin.

In addition, the ground plate 1221 may be shaped as shown by one of a dotted line and a one-dot chain line in FIG. 22 and FIGS. 23A, 23B and 23C, i.e., two ends of the ground plate 1221 may protrude in the direction of the arrow B in reference to the central part of the ground plate 1221. In this manner, the angle θ at the connecting position of the feeder pattern 113 and the feeding unit 622 can be made small. Accordingly, width of the feeding unit 622 can be made small, and, therefore, the antenna device 700 can be miniaturized. Further, the antenna device directivity is also enhanced.

The 12th Embodiment

Figure 24:
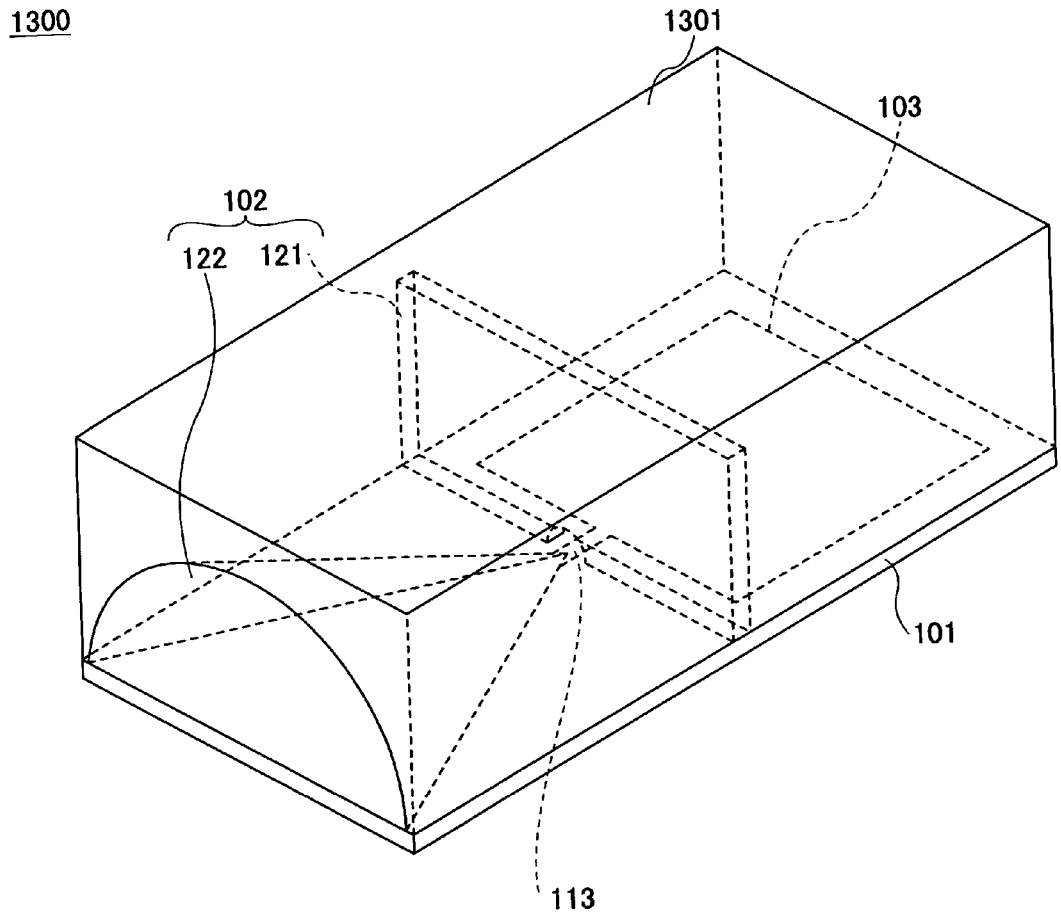
FIG. 24 is a perspective diagram of the antenna device according to the 12th embodiment of the present invention.
Figure 25B:
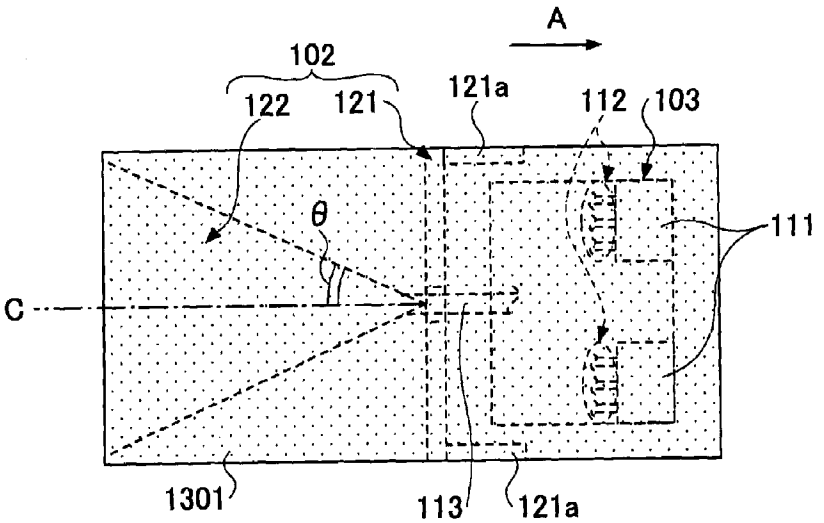
FIGS. 25A, 25B and 25C show top, front, and side views of the antenna device according to the 12th embodiment of the present invention.
Figure 25C:
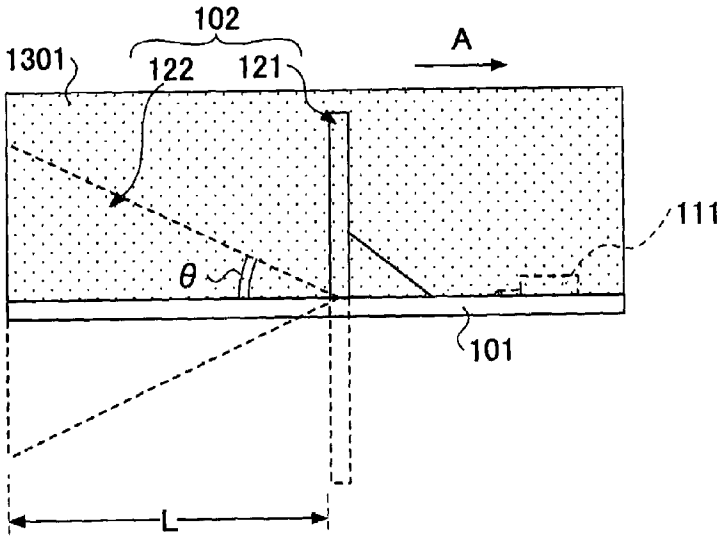
Figure 25A:
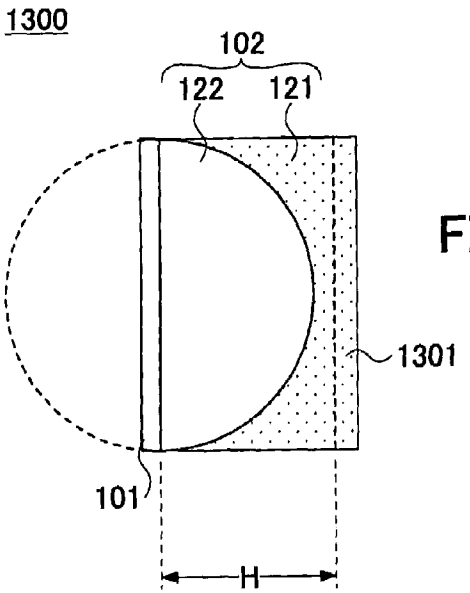

FIG. 24 is a perspective diagram of an antenna device 1300 according to the 12th embodiment of the present invention, and FIGS. 25A, 25B and 25C show top, front, and side views of the 12th embodiment of the present invention. In FIGS. 24 and FIGS. 25A, 25B and 25C, the same reference marks are given to the same components as FIG. 2 and FIGS. 3A, 3B and 3C, and explanations thereof are not repeated.

The antenna device 1300 includes a mold resin section 1301 that seals the antenna device 1300 by a resin material. The mold resin section 1301 seals the whole surface of the dielectric substrate 101 on which the antenna section 102 and the RF circuit section 103 are mounted.

According to this embodiment, the wavelength λ is shortened by a factor of $1/\epsilon^{1/2}$ where ε is a dielectric constant of the mold resin section 1301.

Accordingly, the length L of the feeding unit 102 is shortened by the factor of $1/\epsilon^{1/2}$.

For this reason, the antenna device 1300 is made small.

[The Modification of the Dielectric Substrate 101]

Figure 26:
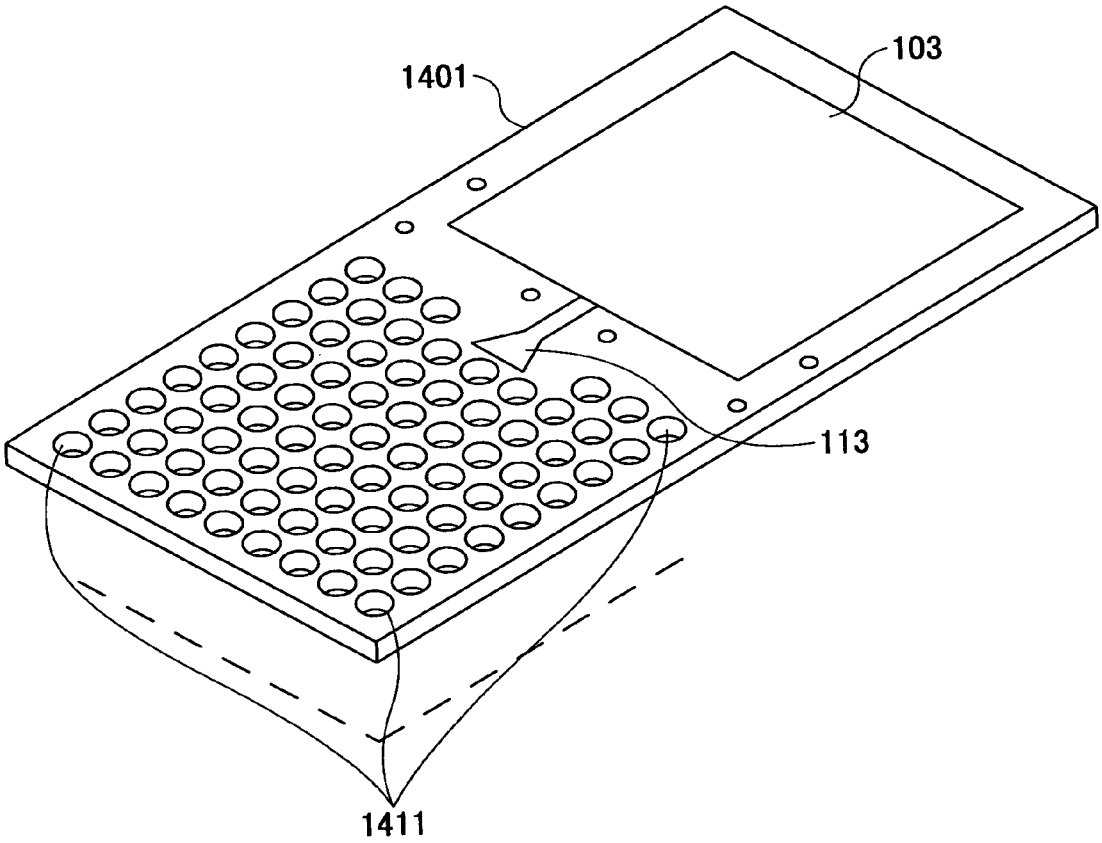
FIG. 26 is a perspective diagram of a dielectric base plate 101 according to a modification to the embodiments of the present invention.

FIG. 26 is a perspective diagram of a dielectric substrate 1401 that is a variation to the dielectric substrate 101 of the embodiment of the present invention. In FIG. 26, the same reference marks are given to the same components as FIG. 2, and explanations thereof are not repeated.

Holes 1411 are formed at a portion of the dielectric substrate 1401 where the antenna section 102 is mounted according to the variation.

By forming the holes 1411 at the portion where the antenna section 102, influence of the dielectric constant of the dielectric substrate 1401 is reduced on the feeding unit 102. Accordingly, a stable operation is realized.

This variation can be applied to, for example, the 12th embodiment. Even when the antenna section 102 is molded by the mold resin section 1301, holes are provided to a portion of the dielectric substrate 101 where the antenna section 102 is mounted like the dielectric substrate 1401. The holes are filled up with the mold resin. The dielectric constants of the dielectric substrate 1401 and the mold resin may differ; however, the influence of the dielectrics of the dielectric substrate can be minimized, and a stable operation is realized.

Further, the present invention is not limited to these embodiments, but various variations and modifications may be made without departing from the scope of the present invention.

The present application is based on Japanese Priority Application No. 2004-023875 filed on Jan. 30, 2004, with the Japanese Patent Office, the entire contents of which are hereby incorporated by reference.

What is claimed is:

1. An antenna device, comprising:

a ground plate shaped like a plate; and a feeding unit that extends from the ground plate for a predetermined length and at a predetermined angle, the feeding unit being perpendicular to the ground plate, wherein the feeding unit is a half-body that is one of two halves of a body divided by a plane perpendicular to the ground plate.

2. The antenna device as claimed in claim 1, wherein the half-body of the feeding unit is a half-body of a circular cone, having an apex facing the ground plate, wherein the half-body of the circular cone is one of two halves of the circular cone divided by a plane perpendicular to the ground plate.

3. The antenna device as claimed in claim 1, wherein the half-body of the feeding unit is a half-body of a structure comprising a circular cone having an apex facing the ground plate and a sphere that is inscribed in the circular cone, wherein the half-body of the structure is one of two halves of the structure divided by a plane perpendicular to the ground plate.

4. The antenna device as claimed in claim 1, wherein the half-body is divided by slicing.

5. The antenna device as claimed in claim 4, wherein the half-body is sliced by the plane perpendicular to the ground plate.

6. The antenna device as claimed in claim 1, wherein a the length of the feeding unit a in directions perpendicular to the ground plate is set at $\lambda/2n$, where $\lambda$ represents a wavelength to be served by the antenna device, and n is a natural number.

7. The antenna device as claimed in claim 1, wherein the ground plate and the feeding unit are mounted on a dielectric substrate.

8. The antenna device as claimed in claim 7, further comprising a plurality of holes in at least a portion of the dielectric substrate, the portion corresponding to the feeding unit and the ground plate.

9. The antenna device as claimed in claim 1, wherein the feeding unit comprises an electrically conductive pattern on a dielectric substrate.

10. The antenna device as claimed in claim 9, wherein the electrically conductive pattern is shaped in a projection form of the feeding unit.

11. The antenna device as claimed in claim 1, wherein the ground plate has a concave shape.

12. The antenna device as claimed in claim 1, wherein the ground plate has a shape of a semicircle.

13. The antenna device as claimed in claim 1, the ground plate has a parabolic shape.

14. The antenna device as claimed in claim 1, wherein the feeding unit comprises an electrically conductive pattern on a dielectric substrate.

15. The antenna device as claimed in claim 1, wherein the antenna device is sealed by a resin material having a predetermined dielectric constant.

* * * * *

UNITED STATES PATENT AND TRADEMARK OFFICE

CERTIFICATE OF CORRECTION

PATENT NO. : 7,023,397 B2
APPLICATION NO. : 10/960038
DATED : April 4, 2006
INVENTOR(S) : Shigemi Kurashima et al.

It is certified that error appears in the above-identified patent and that said Letters Patent is hereby corrected as shown below:

Column 9, Line 40, after “cone” delete “,”.

Column 10, Line 13, after “wherein” delete “a”.

Column 10, Line 14, delete “a”.

Signed and Sealed this

Fourteenth Day of November, 2006

JON W. DUDAS
*Director of the United States Patent and Trademark Office*